US008578565B2

(12) United States Patent
Hienekamp

(10) Patent No.: US 8,578,565 B2
(45) Date of Patent: Nov. 12, 2013

(54) TIGHTENABLE CLAMPING DEVICE, SUITABLE FOR APPLICATION IN TIE WRAPS

(76) Inventor: Willem Hienekamp, Rotterdam (NL)

( * ) Notice: Subject to any disclaimer, the term of this patent is extended or adjusted under 35 U.S.C. 154(b) by 167 days.

(21) Appl. No.: 12/597,427

(22) PCT Filed: Apr. 29, 2008

(86) PCT No.: PCT/NL2008/000120

§ 371 (c)(1),
(2), (4) Date: Oct. 23, 2009

(87) PCT Pub. No.: WO2008/136660

PCT Pub. Date: Nov. 13, 2008

(65) Prior Publication Data

US 2010/0125979 A1 May 27, 2010

(30) Foreign Application Priority Data

May 4, 2007 (NL) ..... 1033810

(51) Int. Cl.
*B65D 63/00* (2006.01)

(52) U.S. Cl.
USPC ..... 24/19; 24/16 R; 24/16 PB

(58) Field of Classification Search
USPC ..... 24/16 R, 16 PB, 19, 190
See application file for complete search history.

(56) References Cited

U.S. PATENT DOCUMENTS 3,537,146 A * 11/1970 Caveney ..... 24/16 PB
3,717,906 A * 2/1973 Wells ..... 24/16 PB
3,735,448 A * 5/1973 Waddington ..... 24/16 PB
3,906,593 A * 9/1975 Caveney et al. ..... 24/16 PB
3,908,233 A * 9/1975 Caveney et al. ..... 24/16 PB
3,949,449 A * 4/1976 Caveney et al. ..... 24/16 PB
3,965,538 A * 6/1976 Caveney et al. ..... 24/16 PB
3,967,345 A * 7/1976 Sumimoto ..... 24/16 PB
4,137,606 A * 2/1979 Wood ..... 24/16 PB
RE31,541 E * 3/1984 Wood ..... 24/16 PB
4,532,679 A * 8/1985 Scott ..... 24/16 PB
4,680,834 A * 7/1987 Andre et al. ..... 24/16 PB
4,776,067 A * 10/1988 Sorensen ..... 24/16 PB
4,908,911 A * 3/1990 Bretti et al. ..... 24/16 PB
5,193,250 A * 3/1993 Caveney ..... 24/16 PB
5,208,948 A * 5/1993 Nirei ..... 24/16 PB (Continued)

FOREIGN PATENT DOCUMENTS

FR 2849146 A1 * 6/2004 ..... F16L 3/233

*Primary Examiner* — Robert J Sandy
*Assistant Examiner* — David Upchurch

(57) ABSTRACT

A clamping device (1) is adapted to receive and retain a portion (21) of a strip (20), and to actively tighten itself around the strip portion (21) under the influence of a pulling force. This is functioning in such a way that the higher the pulling force, the higher the force with which pushing parts (31) of the clamping device (1) are pushed. This results in a firm clamping connection. On the basis of this functioning, the clamping device (1) can be embodied in a form which has an open side, while maintaining a high capacity of withstanding loads. This results in the advantageous property that the strip (20) can be placed in and removed from the clamping device (1) in a sideward direction. This allows for detachment and reuse, and increases speed and convenience of use. The strip (20) does not need to be inserted in a closed shape. Various other applications than in a tie wrap (10) are possible for the clamping device (1), including applications in tension belts.

15 Claims, 8 Drawing Sheets

(56) References Cited

U.S. PATENT DOCUMENTS

| | | | | |
|---|---|---|---|---|
| 5,745,957 | A * | 5/1998 | Khokhar et al. | 24/16 PB |
| 5,890,265 | A * | 4/1999 | Christian et al. | 24/16 PB |
| 6,070,304 | A * | 6/2000 | Lii | 24/16 PB |
| 6,807,714 | B2 * | 10/2004 | O'Young et al. | 24/16 PB |
| 6,991,102 | B2 * | 1/2006 | Kurmis | 206/343 |
| 7,360,281 | B1 * | 4/2008 | MacCartey et al. | 24/16 PB |
| 2002/0083559 | A1 * | 7/2002 | Hatch | 24/16 PB |
| 2007/0039136 | A1 * | 2/2007 | Assarsson | 24/16 PB |
| 2007/0175001 | A1 * | 8/2007 | Tomory et al. | 24/16 PB |
| 2007/0266531 | A1 * | 11/2007 | Krisel | 24/16 PB |

* cited by examiner

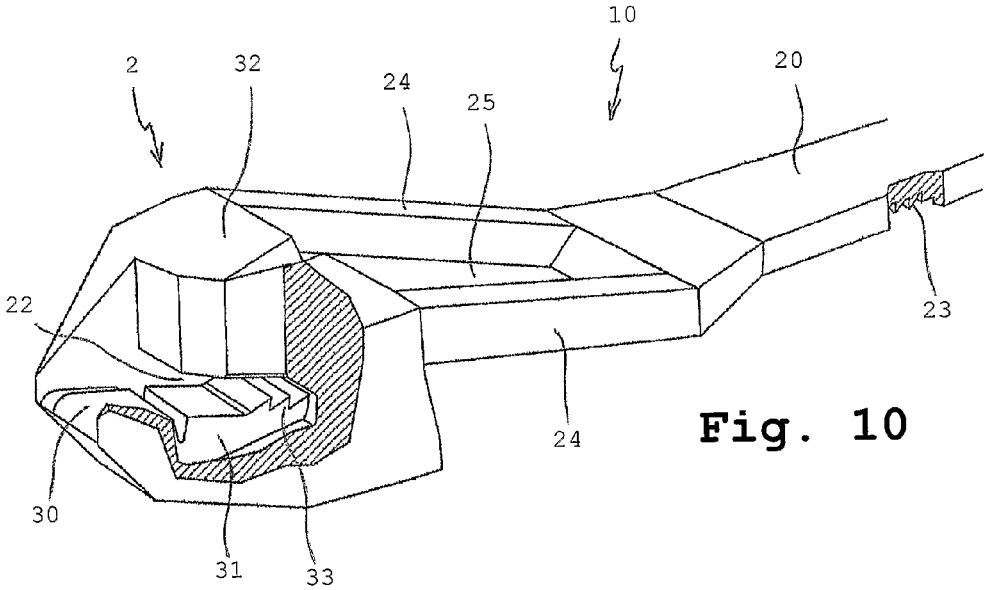
Fig. 10
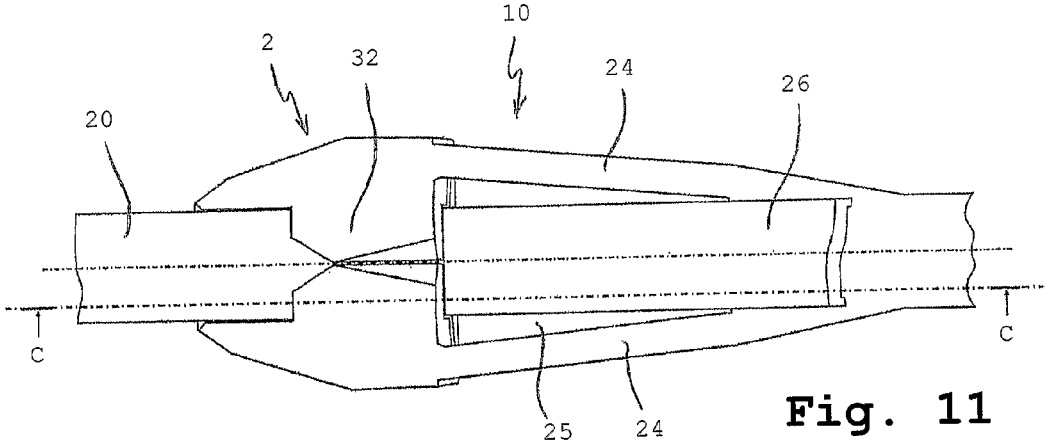
Fig. 11
Fig. 12
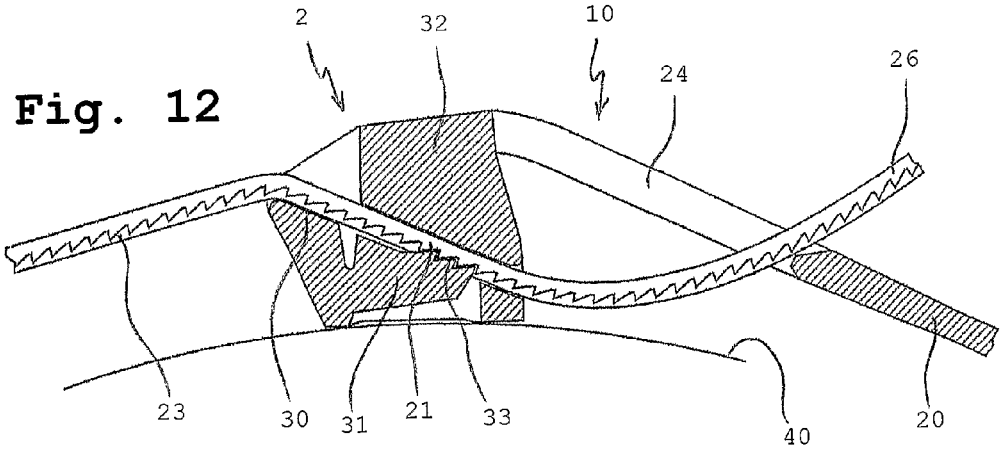

TIGHTENABLE CLAMPING DEVICE, SUITABLE FOR APPLICATION IN TIE WRAPS

BENEFIT CLAIMS

This application is a US National Stage of International Application No. PCT/NL2008/000120, filed 29 Apr. 2008, which claims the benefit of NL 1033810, filed 4 May 2007.

The present invention relates to a device for receiving and retaining a portion of a body.

BACKGROUND OF THE INVENTION

Such a device is known, and may be a component of a so-called tie wrap, for example, i.e. an elongated, narrow object which is usually manufactured of a flexible plastic such as nylon, and which is intended to be tightened around one or more other objects. In particular, a tie wrap comprises an elongated, narrow strip and a retaining element which is connected to an end of the strip, which is shaped like a rectangular ring, and which has a projection at an inner surface thereof. In an application of a tie wrap, a closed loop is formed by putting a free end of the strip through the retaining element. The inner dimensions of the retaining element are adapted to receiving the strip with only small play.

A surface of the strip which is located at the side of the projection of the retaining element in forming the loop is provided with teeth having inclined surfaces. The orientation of these surfaces is such that in reducing the size of the loop for the purpose of tightening the tie wrap around one or more objects, an inclined surface of a tooth slides over the projection in a direction in which the surface is rising. Due to this, the strip is pushed away from the projection, and the retaining element is elastically deformed to some extent, until an uppermost point of the inclined, rising surface of the tooth is reached, and the tooth is moved completely beyond the projection. At that point, there is room for the retaining element to assume its original shape, and the tooth is no longer capable of moving back, because the projection is in the way and is located at the side of the uppermost point of the inclined, rising surface of the tooth. Therefore, the strip can only be moved through the retaining element in one direction, namely the direction in which the loop is getting smaller.

During a movement of the strip through the retaining element, successive teeth are constantly displaced beyond the projection by exerting a pulling force on the strip. On the basis of the elastic properties of the material of the strip, it is possible to tighten the tie wrap around one or more objects, wherein the loop of the tie wrap remains closed because at least one of the teeth of the strip is in contact with the projection of the retaining element and cannot move beyond it because the strip is located in the retaining element with only small play.

In spite of the fact that the known tie wrap is suitable for many practical applications, it is a disadvantage of this tie wrap that, taking into account a situation in which the loop has a desired size, in case of an increase of forces which are aimed at making the loop larger, particularly pulling forces which are exerted on the retaining element at the position of the attachment of the strip to the retaining element, the shape of the retaining element eventually changes. Due to this, a coupling which was originally present between the retaining element and a portion of the strip is lost, wherein the tie wrap looses its functionality as a result of a lasting deformation of the retaining element.

Another disadvantage of the known tie wrap is related to the shape of the retaining element, and the associated fact that a user of the tie wrap needs to take trouble to put the free end of the strip through the retaining element.

BRIEF SUMMARY OF THE INVENTION

It is an objective of the invention to provide a solution for at least one of the above-sketched disadvantages of the known tie wrap. This objective is reached by a device for receiving and retaining a portion of a body, which is adapted to tighten itself around a portion of the body on the basis of a pulling force exerted thereon.

In the known tie wrap, the retaining element functions as device for receiving and retaining a portion of a body, namely a portion of the strip. However, an essential difference between the known clamping device and the clamping device according to the invention is that the clamping device according to the invention is adapted to carry out a function of actively being wrapped tightly around the portion of the body under the influence of a pulling force. In this way, it is achieved that when the pulling force increases, the portion of the body is tightened even more in the clamping device, while pulling open of the clamping device is out of the question. The capability to withstand high pulling forces without loss of the coupling of the clamping device to a portion of a body is an important advantage which is related to the invention.

In a practical embodiment, the clamping device according to the invention comprises force means movably arranged therein, which are destined to engage a portion of the body, wherein the clamping device is adapted to allow the force means to exert a pushing force on the basis of a pulling force which is exerted thereon. The clamping device can be shaped in such a way that a part of the clamping device may be regarded as rod assembly, wherein the rod assembly is adapted to realize a pushing force on one side of the rod assembly on the basis of a pulling force which is exerted on another side of the rod assembly.

The movably arranged force means of the clamping device may, for example, comprise at least two force parts, wherein an arrangement of the force parts in the clamping device is aimed at letting the force parts exert a pushing force from different directions when a pulling force is exerted on the clamping device. With the help of such force parts, it is possible to push against a portion of a body in the clamping device. In a practical embodiment, the clamping device further comprises means for supporting the portion of the body. Such means may comprise, for example, a single support element, which may possibly be pivotably arranged in the clamping device. For the purpose of enhancing a retaining action of the clamping device on the portion of the body, it is advantageous when the force parts and/or the support element are provided with means such as teeth for enhancing engagement to the portion of the body.

Further, the clamping device according to the invention is adapted to pull the force parts towards each other on the basis of a pulling force exerted thereon. By doing so, it is realized that the clamping device may tighten itself around a portion of a body, and that in case of an increase of a pulling force which is exerted on the clamping device, there is no danger of the clamping device bending open or changing its shape in another way.

In various possible embodiments of the clamping device according to the invention, the clamping device is embodied in a mirror-symmetrical manner, in a functional sense, and four important points are distinguishable at both sides of the clamping device, namely an acting point for a pulling force, a basic point of the force means, a contact point on the force means for contact to a portion of a body to be received, and a contact point on another element of the clamping device for contact to a portion of the body to be received. In various embodiments of the clamping device, pulling the clamping device to a closed condition under the influence of a pulling force is achieved when the points are located in one imaginary plane, or when the acting point for the pulling force is located more to the inside in the clamping device.

In an advantageous embodiment, the clamping device according to the invention is shaped in such a way that it is possible to easily insert a portion of a body to be received in the clamping device. This may, for example, be the case when the clamping device has movable elements, and, with these elements, is capable to assume an opened position and a closed position, wherein, in the opened position, the clamping device has a free passage for the portion of the body to and from a space in the clamping device for receiving the portion of the body in a sideward direction, i.e. transverse to a longitudinal direction of the body, and wherein, in the closed position, the clamping device tightens itself around the portion of the body, and there is no free passage any more. It is easier to a user of the clamping device to insert a portion of a body when it is possible to place the said portion directly in the space destined thereto in this way, than when the body needs to moved through the clamping device along a length first, as is the case with a known tie wrap, for example.

Particularly in an embodiment in which the clamping device according to the invention comprises movable elements which may provide access to a passage in a sideward direction to a space for receiving a portion of a body, it is advantageous when closure means which are destined to get engaged with each other when they are moved towards each other are applied. Due to this, it may be guaranteed that, once established, a coupling of the clamping device and the respective body is not lost when a pulling force on the clamping device is (temporarily) relieved. The application of the closure means provides a locking of said coupling, as it were, wherein, in a condition of engagement, the closure means can also contribute to a certain extent to a clamping force which is exerted on a portion of a received body by the clamping device. The closure means can be embodied in any suitable way, and may, for example, comprise elements having portions which may catch each other like hooks. Apart from that, the application of closure means as mentioned above is not limited to the clamping device according to the invention, but other types of devices for receiving and retaining a portion of a body may also be provided with such closure means to lock a coupling of the device and the portion of the body.

As is apparent from the foregoing, the invention provides a clamping device in which a portion of a body may easily be inserted, and which is capable of tightening itself around this portion under the influence of a pulling force. When the portion of the body is located in the clamping device, the pulling force may, for example, be realized by pulling the clamping device in one direction and pulling the body in a more or less opposite direction. A tightened condition of the clamping device which is obtained in this way can be locked when the clamping device comprises closure means which are suitable for that purpose. When such closure means are detachable, or not present at all, an engagement of the clamping device to the portion of the body may be detached if so desired by no longer pulling the clamping device and the body, or by realizing another mutual orientation of the directions in which the clamping device and the body are pulled. The possibility to detach said engagement and use the clamping device again is an important advantage which is related to the invention.

In connection with the possibility of realizing a free passage to and from a space in the clamping device for receiving a portion of a body, it is noted that WO 96/18554 shows a tie wrap of which the retaining element has an open shape. Also in this tie wrap, the components thereof are manufactured from a resilient material. The portion of the body can be moved between two parts of the retaining element having inwardly directed teeth, wherein these parts spring outwards to some extent. As soon as the portion of the body is located at the proper position in the retaining element, the retaining element can assume its shape again, wherein the teeth of the two parts engage the portion of the body, and the portion of the body is closely surrounded by an inner surface of the retaining element. Possibly, the portion of the body can be tightened against the parts having the teeth by inserting an element in an opening which is located right underneath the space in which the portion of the body is received, whereby it is achieved that an inner surface of the retaining element is pushed against the portion of the body.

An important disadvantage of this known tie wrap is that the retaining element is not capable of further actively tightening itself around the portion of the body, as a result of which, in case of increasing pulling force in the body, a situation soon arises in which the retaining element bends open, and the engagement to the portion of the body is lost. Due to the fact that the retaining element of the known tie wrap does not have the functioning of the clamping device according to the invention, this tie wrap may have the advantage of the possibility of easily inserting a portion of a body in the retaining element in a sideward direction, but this tie wrap can only be loaded to a relatively small extent.

Besides to the clamping device as described above, the invention also relates to an assembly of a flexible body having an elongated shape and said clamping device, wherein the body and the clamping device are connected to each other, and wherein the clamping device is destined to be applied for receiving and retaining a portion of the body. The assembly according to the invention may, for example, be suitable to be applied as tie wrap or as waistbelt.

In an advantageous embodiment of the assembly, a portion of the body is split and has two parts, wherein the body is connected to the clamping device through the split part, and wherein the two parts of the split portion are attached to the clamping device at different positions. In this way, it can be achieved that a pulling force exerted on the clamping device through the body acts on the clamping device at two points, with which is it possible to realize a pushing force from two directions.

The invention further relates to a device for receiving and retaining a portion of a body, wherein at least a part of a surface of the clamping device, which is destined to contact a portion of the body, is provided with means such as teeth for enhancing engagement of the surface to the portion of the body, and wherein these means comprise at least two parts such as two rows of teeth, which are arranged substantially parallel with respect to each other. The invention also relates to an assembly of a flexible body having an elongated shape and such a clamping device.

An important advantage of the clamping device of which the means for enhancing engagement of at least a part of a surface of the clamping device to a portion of a body comprise two parts is that when the body is located in the clamping device and is moved through the clamping device, the force which is needed for pulling the body may be lower than when the means for enhancing said engagement would comprise a single part having the size of the said two parts. In the process, a free end of the body is continually moved in alternating directions, wherein the free end of the body is continually positioned inclined and sideward with respect to the clamping device, so that it is achieved that the body passes over the two parts in an alternating fashion. In this way, it may be easier to a user to tighten an assembly of clamping device and body around one or more objects.

An alternative way in which the above-described tightening process may be realized comprises providing two support edges on the clamping device, wherein two separate, parallel extra rows of teeth are also provided, at an outer side of the clamping device, at a place where the body exits the clamping device.

BRIEF DESCRIPTION OF THE DRAWINGS

The invention will be explained in more detail on the basis of the following description. In the process, reference will be made to the drawing, in which equal reference signs indicate equal or similar components, and in which:

FIGS. 6 and 7 show a view of a cross-section along line B-B in FIG. 2, in respect of two mutually different positions of closure parts of the clamping device, wherein FIG. 7 shows an opened position which allows for inserting or removing a portion of the strip in a direction transverse to a longitudinal direction;

FIG. 10 shows a partially cut-away perspective view of a second embodiment of a clamping device according to the invention and a portion of a flexible strip connected thereto;

FIG. 11 shows a top view of the clamping device according to the second embodiment of the invention and a portion of the flexible strip, wherein the strip is extending through the clamping device, and the clamping device is in a closed condition;

FIG. 12 shows a view of a longitudinal section along line C-C in FIG. 11;

DETAILED DECRIPITION OF PREFERRED EMBODIMENTS

Figure 1:
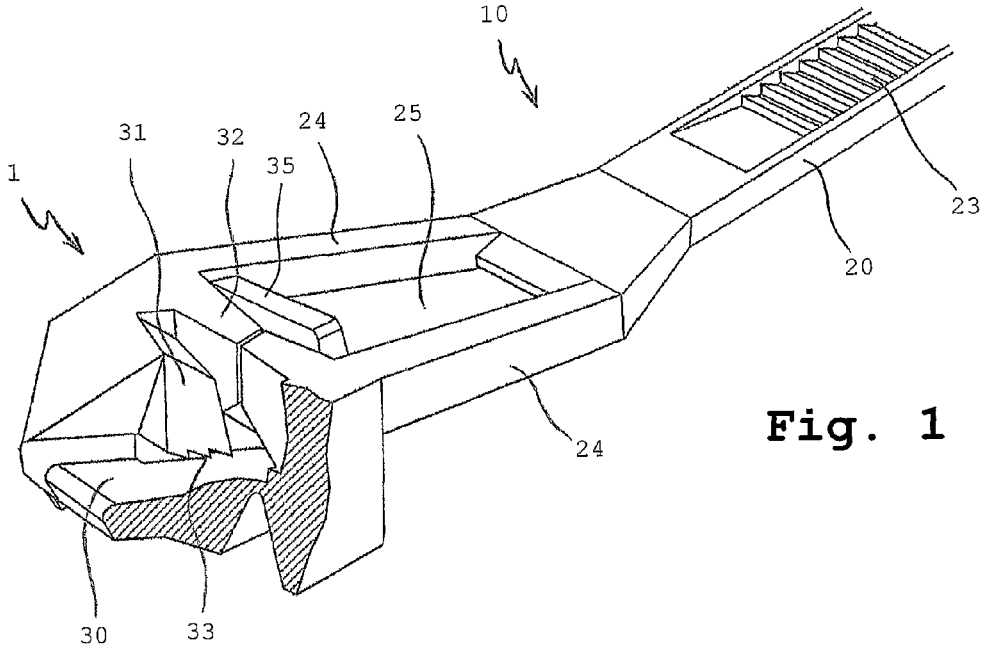
FIG. 1 shows a partially cut-away perspective view of a first embodiment of a clamping device according to the invention and a portion of a flexible strip connected thereto.
Figure 2:
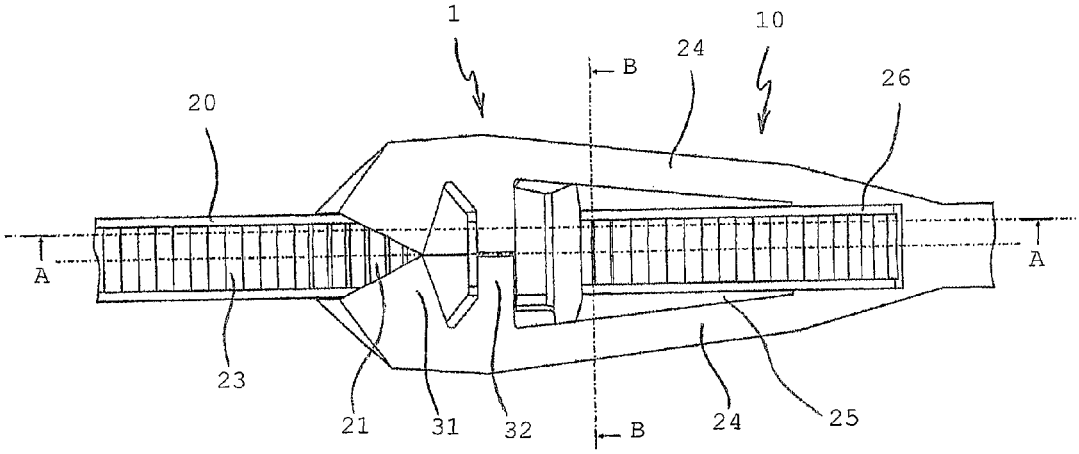
FIGS. 2 and 3 show different views of the clamping device according to the first embodiment of the invention and a portion of the flexible strip, wherein the strip is extending through the clamping device, and the clamping device is in a closed condition.
Figure 3:
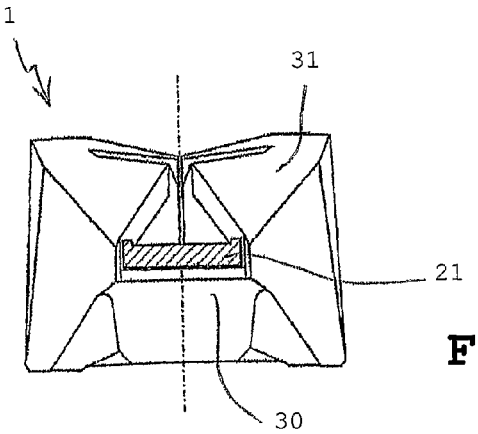

FIG. 1 shows a first embodiment of a clamping device 1 according to the invention and a portion of a flexible strip 20 which is connected to the clamping device 1. The assembly 10 of the clamping device 1 and the strip 20 is particularly destined to be applied as tie wrap, and will therefore be indicated as such in the following. In view of said application, the clamping device 1 and the strip 20 are manufactured from nylon or another suitable, preferably resilient plastic, or a combination of different plastics having possibly one or more other substances.

When the tie wrap 10 is applied by a user, he/she puts the tie wrap 10 to a functional condition by inserting a portion 21 of the strip 20 in the clamping device 1. In FIGS. 2, 3, 4 and 5, a situation in which the strip 20 is extending through the clamping device 1 is illustrated. On the basis of the fact that the strip 20 is fixedly connected to the clamping device 1 at one side, and is extending through the clamping device 1 at another place, a closed loop (not shown) is formed in this situation. In particular, at the position of the attachment to the clamping device 1, the strip 20 is split in two parts 24. The function thereof will be explained in the following. Further, the way in which the strip portion 21 is inserted in the clamping device 1, and the way in which a clamping coupling between the clamping device 1 and the strip portion 21 is subsequently realized will be described in the following.

Figure 6:
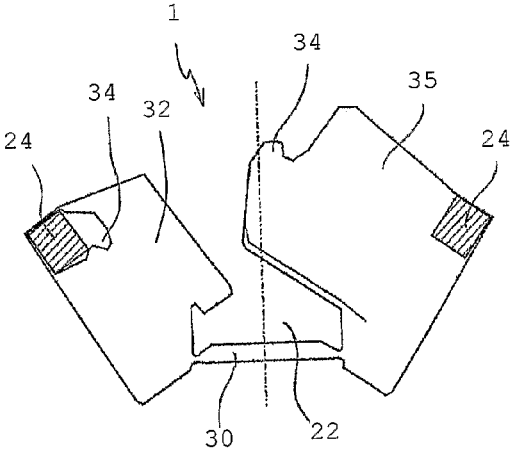
Figure 7:
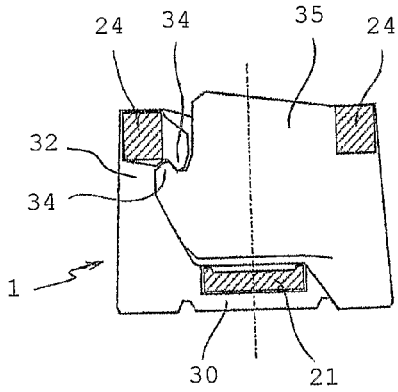

In FIG. 6, it can clearly be seen that the clamping device 1 has a space 22 for receiving and accommodating the strip portion 21. In an initial condition of the clamping device 1, as illustrated in FIG. 6, which will hereinafter be referred to as opened condition of the clamping device 1, the space 22 is freely accessible from a side of the clamping device 1 which will hereinafter be indicated as top side. In a closed condition of the clamping device 1, as illustrated in FIG. 7, and also in FIGS. 2, 3, 4 and 5, the strip portion 21 is locked in the clamping device 1.

In particular, the clamping device 1 comprises a strip support element 30 to which a number of elements of the clamping device 1 are pivotably connected. In the shown example, these elements comprise ratchet parts 31 and closure parts 32, wherein the closure parts 32 are located closer to the side of the clamping device 1 where the fixed connection to the strip 20 is, which will hereinafter be referred to as back side of the clamping device 1, than the ratchet parts 31. When the clamping device 1 is put from the opened condition to the closed condition, the ratchet parts 31 and the closure parts 32 are rotated inwardly and downwardly, along an axis which is extending parallel with respect to a longitudinal axis of the clamping device 1 and the strip 20 connected thereto, or is extending with small deviation with respect to said longitudinal axis.

Figure 4:
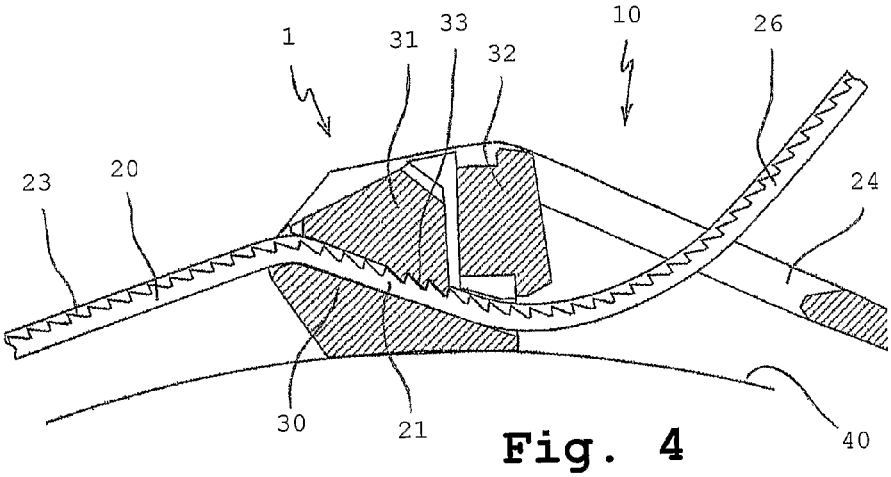
FIG. 4 shows a view of a longitudinal section along line A-A in FIG. 2.
Figure 5:
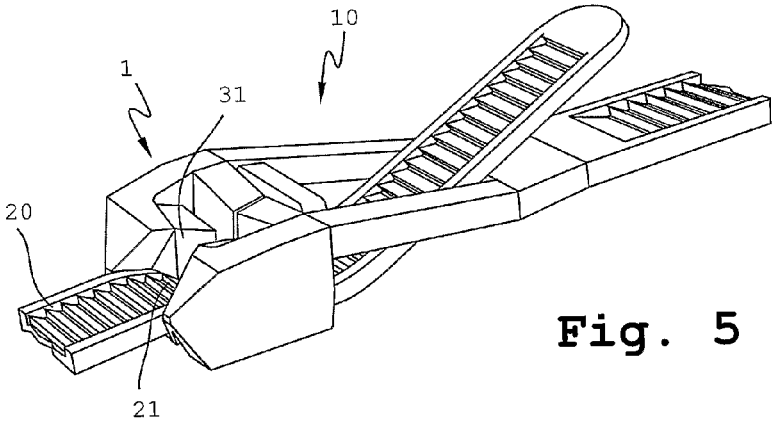
FIG. 5 shows a perspective view of the clamping device according to the first embodiment of the invention and a portion of the flexible strip, wherein the strip is extending through the clamping device, and the clamping device is in a closed condition.

The ratchet parts 31 serve for actually engaging the strip portion 21, while the strip portion 21 is supported by the strip support element 30. In order to enhance the engagement of the ratchet parts 31 to the strip portion 21, both the strip 20 and the ratchet parts 31 are provided with a toothing 23, 33, wherein the shape of the teeth of both toothings 23, 33 are chosen such that the toothings 23, 33 may engage each other in a fitting fashion, as can be seen in FIG. 4. Apart from that, an alternative embodiment of the clamping device 1 is feasible, wherein the ratchet parts 31 are displaced by components without toothing 33, which are fixedly arranged in the clamping device 1, wherein a toothing 33 is provided on the component which is functioning as strip support element 30 in the shown embodiment, and wherein the toothing 23 of the strip 20 is positioned at another side, so that it is also possible to realize an engagement of both toothings 23, 33 in this embodiment.

The clamping device 1 comprising locking means for locking a coupling between the clamping device 1 and the strip portion 21. When the clamping device 1 is in an opened condition and the strip portion 21 is placed in the clamping device 1, the clamping device 1 is closed by exerting a pulling force through the strip 20, at the position of the attachment of the strip 20 to the clamping device 1, while, at the front side of the clamping device 1, the strip 20 is simultaneously pulled in a more or less opposite direction. This is automatically realized when the strip 20 is tightened around one or more objects. When this pulling force is relieved again, the locking means prevent the clamping device 1 from immediately assuming the opened condition again. To this end, hook elements 34 are provided, which are catching each other when the clamping device 1 is closed, wherein one of the hook elements 34 is situated on a locking element 35 located directly behind the closure parts 32, and wherein another of the hook elements 34 is directly connected to a closure part 32 and a part 24 of the strip 20. FIG. 7 shows the coupled condition of the hook elements 34 in the closed condition of the clamping device 1.

Figure 8:
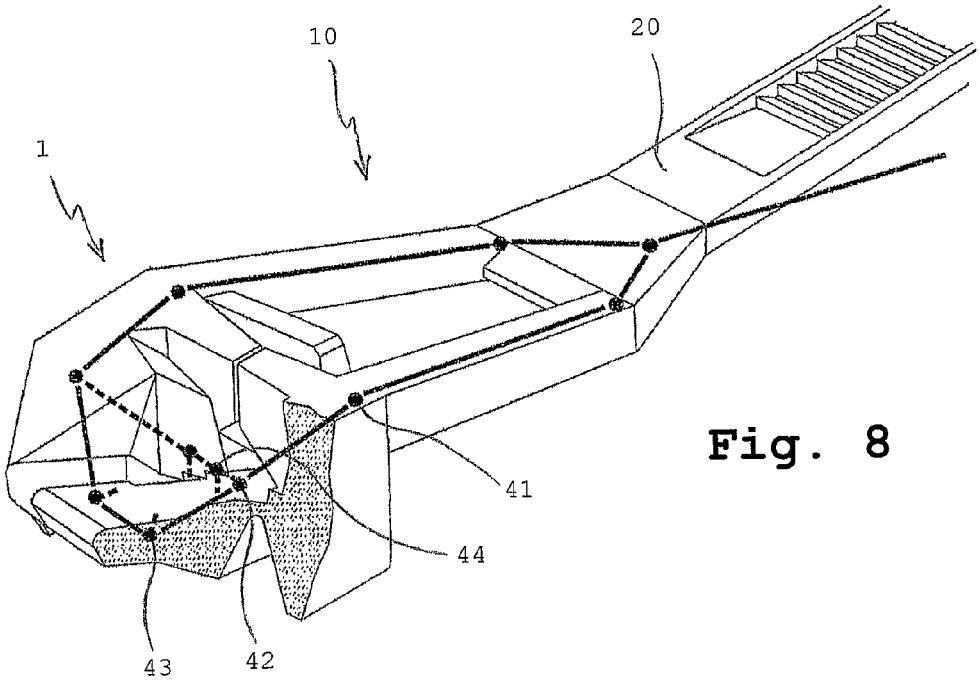
FIG. 8 diagrammatically shows a combination of forces which is obtained under the influence of a pulling force in the clamping device according to the first embodiment of the invention.

As has already been indicated in the foregoing, the clamping device 1 is put to a closed condition, and the toothing 33 of the ratchet parts 31 is put to engagement to the toothing 23 of the strip 20 when a pulling force is exerted on the clamping device 1. FIG. 8 serves to illustrate this fact, wherein, for sake of clarity, the strip portion 21 extending through the clamping device 1 is not shown. In the figure, pulling forces are diagrammatically depicted by means of a continuous line, whereas pushing forces are diagrammatically depicted by means of a dashed line.

At the position of the attachment to the clamping device 1, the strip 20 is split in two parts 24, so that it is achieved that the clamping device 1 and the strip 20 are fixedly connected to each other at two positions. When a pulling force is exerted by the strip 20, it is thus realized that this pulling force acts on the clamping device 1 at two points 41. On the basis thereof, at two sides of the clamping device 1, the following combination of forces is obtained. The pulling force is transmitted to a point 43 on the strip support element 30 where the strip 20 is contacting this element 30, through an attachment point 42 of the ratchet part 31. Because the acting point 41 of the pulling force and the point 43 on the strip support element 30 where the strip 20 is contacting this element 30 are located at different levels, it is hereby achieved that the pulling force is directed around the ratchet part 31, as it were, which has as a consequence that the ratchet part 31 is tightened against the strip portion 21 and exerts a pushing force thereon at the position of a contact point 44. In the process, the strip support element 30 provides the necessary counterpressure.

It follows from the foregoing that, at two sides of the clamping device 1, the ratchet parts 31 are tightened against the strip portion 21 under the influence of a pulling force which is exerted on the clamping device 1. In this respect, it is true that when the pulling force increases, the extent to which the clamping device 1 is tightened around the strip portion 21, in other words, the extent to which the clamping device 1 clamps the strip portion 21, increases as well. It follows that at a higher load of the tie wrap 10, the clamping force 1 is kept closed in an active way. This is an important advantage of this clamping device 1 with respect to known constructions in which there is no situation of active pushing, as a result of which effects as loss of shape and associated loss of an engaging action occur at an increase of the load.

Figure 9:
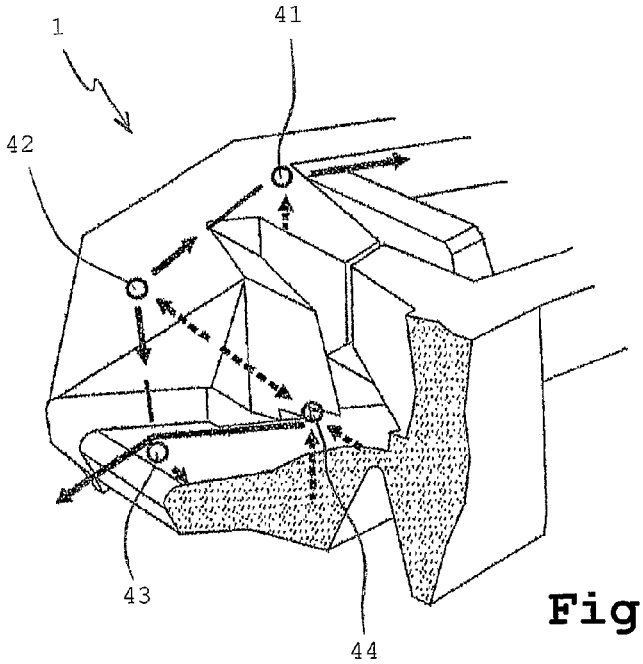
FIG. 9 diagrammatically shows a combination of forces which is obtained when the clamping device according to the first embodiment of the invention is pulled on the one hand, and the flexible strip is pulled in a position in which it is extending through the clamping device on the other hand.

FIG. 9 illustrates how pulling and pushing forces are balanced at the position of each point 41, 42, 43, 44, for one side of the clamping device 1, wherein the pulling forces prevailing in the strip 20 are also shown. Just like in FIG. 8, a continuous line is applied for the indication of pulling forces and a dashed line is applied for the indication of pushing forces in this figure.

In FIG. 4, it is shown that use can be made of a support basis 40 for supporting the clamping device 1 when it is tightened around the strip portion 21. Shapes of parts with which the clamping device 1 is supported on the support basis 40 are chosen such that the interaction between the clamping device 1 and the support basis 40 can contribute to the combination of forces in the clamping device 1 in a desired way.

Further, it is shown in FIG. 4 that a space 25 between the two parts 24 which the strip 20 has at the attachment to the clamping device 1 can be applied to let pass a free portion 26 of the strip 20. When it is desired that the loop formed by the strip 20 gets smaller, for example in a situation in which the tie wrap 10 needs to be pulled more tightly around one or more objects, this can be realized by pulling the free portion 26 of the strip 20, wherein the clamping device 1 can be left in a closed condition, assuming that the components of the clamping device 1 are sufficiently pivotable with respect to each other. This exerting of pulling force at the free end 26 of the strip 20 can take place in upward directions, i.e. directions away from the longitudinal axis of the clamping device 1, wherein the locking element 35 and the hook elements 34 keep the clamping device 1 closed. In the process, it is advantageous that there are two ratchet parts 31, each having their own toothing 33, because it is possible to maneuver the free portion 26 in such a way that the toothing 23 of the strip 20 is continually displaced over the toothing 33 of the one ratchet part 31 by a tooth first, and then is displaced over the toothing 33 of the other ratchet part 31 by a tooth. In the process, the portion 26 of the strip 20 is continually pulled to an inclined position with respect to the longitudinal axis of the clamping device 1, in an alternating movement. The forces which are needed in the process, are smaller than when the toothing 33 needs to be moved over a single toothing which is approximately as wide as a combination of the two toothings 23 of the ratchet parts 31.

In an alternative embodiment of the clamping device 1, the closure parts 32 are adapted to carry out a locking function without further application of hook elements 34 or the like. In such a case, the free portion 26 of the strip 20 can be used to put the clamping device 1 from a closed condition to an opened condition in an easy way, namely by pulling this portion 26 upward.

FIG. 10 shows a second embodiment of a clamping device 2 according to the invention and a portion of a flexible strip 20 which is connected to the clamping device 2. As is the case with the first embodiment of the clamping device 1 described in the foregoing, the assembly 10 of the second embodiment of the clamping device 2 and the strip 20 is destined to be applied as tie wrap 10. In general, the second embodiment of the clamping device 2 functions in the same way as the first embodiment of the clamping device 1, in the sense that it is capable of tightening itself around a strip portion 21 under the influence of a pulling force.

The second embodiment of the clamping device 2 comprises a single ratchet part 31, which is pivotably arranged to a limited extent, and which, in comparison with the first embodiment of the clamping device 1, is located at the place of a part of the strip support element 30 that is most at the back. Due to this, it is achieved that the toothing 33 of the ratchet 31 is directed at the closure parts 32. In comparison with the first embodiment of the clamping device 1, only a part of the strip support element 30 that is most at the front is present in the second embodiment of the clamping device 2.

Just like the first embodiment of the clamping device 1, the second embodiment of the clamping device 2 can assume an opened condition and a closed condition. FIGS. 11 and 12 show the second embodiment of the clamping device 2 in a closed condition, wherein a strip portion 21 is located in the clamping device 2. In FIG. 12, it can be seen that in this condition, the toothing 23 of the strip portion 21 and the toothing 33 of the ratchet portion 31 are engaging, while the closure parts 32 are contacting a side of the strip portion 21 where no teeth are present. On the basis of the pivotable arrangement of the ratchet part 31, it is possible to pull the strip 20 further through the clamping device 2 in a closed condition of the clamping device 2, if so desired.

In accordance with the first embodiment of the clamping device 1, the second embodiment of the clamping device 2 may comprise means like hook elements 34 for maintaining the closed condition, wherein these means may, for example, be provided on the closure means 32. In this respect, it is noted that it is possible that the pivot places which are located between the ratchet part 31 and the closure parts 32 on the one hand and the strip support element 30 on the other hand are embodied in such a way that not all pivot points are located at a single line. Due to this, it is achieved that by an elastic deformation during a pivoting movement, an opened position and a closed position are distinguished and stabile, wherein a closure force exerted by the closure means is enhanced.

Figure 13:
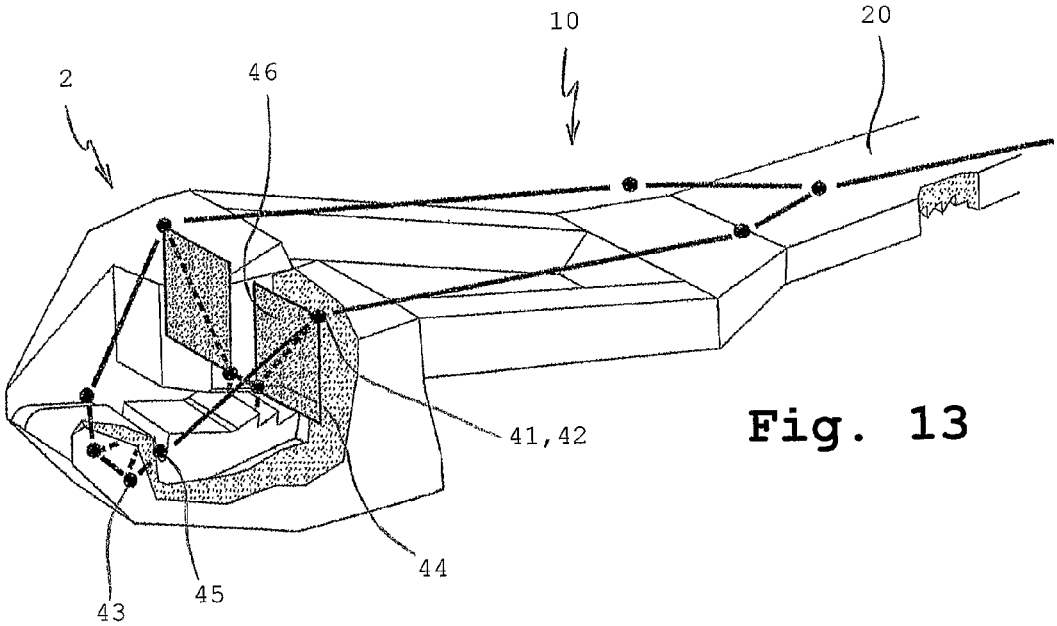
FIG. 13 diagrammatically shows a combination of forces which is obtained under the influence of a pulling force in the clamping device according to the second embodiment of the invention.

FIG. 13 is comparable to FIG. 8, and illustrates a combination of forces which is realized when a pulling force is exerted on the clamping device 2. In this case, the point 41 on which the pulling force is acting and the attachment point 42 of a part for exerting a pushing force on the strip portion 21, in this case a closure part 32, are coinciding. The pulling force is transmitted to a fixed point 43 on the strip support element 30 through a pivot point 45 between the closure part 32 and the strip support element 30. The acting point 41 for the pulling force and the fixed point 43 at the strip support element 30 are located at different levels, and due to this, a pushing force on the strip 20 is realized, as is the case with the first embodiment of the clamping device 1. In this second embodiment of the clamping device 2, the closure parts 32 are pulled against the strip portion 21 under the influence of the pulling force, and are exerting a pushing force thereon at the position of contact points 44. In the process, both the strip support element 30 and the ratchet part 31 provide a counter-pressure.

In FIG. 13, it is also illustrated that the pushing force exerted by the closure parts 32 acts in a plane 46 which is extending substantially perpendicular to a longitudinal axis of the clamping device 2. Further, it is shown in FIG. 12 that use can be made of a support basis 40 to support the clamping device 2 when it is tightened around the strip portion 21.

Figure 14:
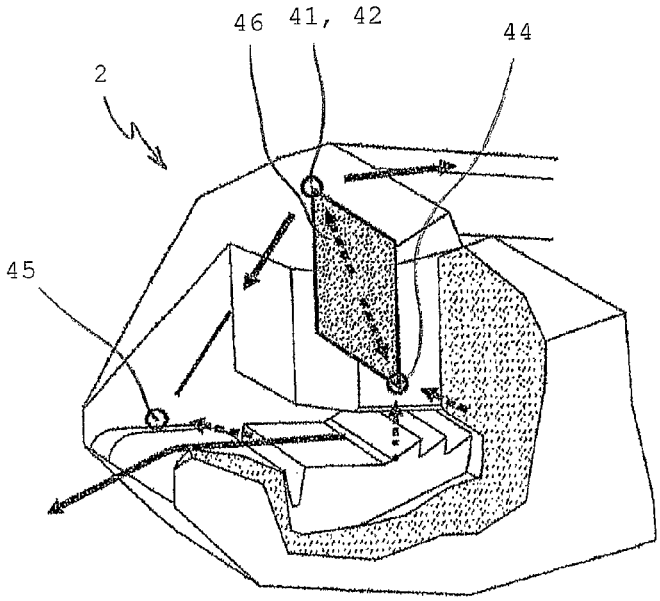
FIG. 14 diagrammatically shows a combination of forces which is obtained when the clamping device according to the second embodiment of the invention is pulled on the one hand, and the flexible strip is pulled in a position in which it is extending through the clamping device on the other hand.

FIG. 14 is comparable to FIG. 9, and illustrates how pulling and pushing forces are balanced at the position of a number of points 41, 42, 44, 45, for one side of the clamping device 2, wherein the pulling forces prevailing in the strip 20 are also shown. Further, FIG. 14 shows the plane 46 in which the pushing force exerted by a closure part 32 is acting.

Figure 15:
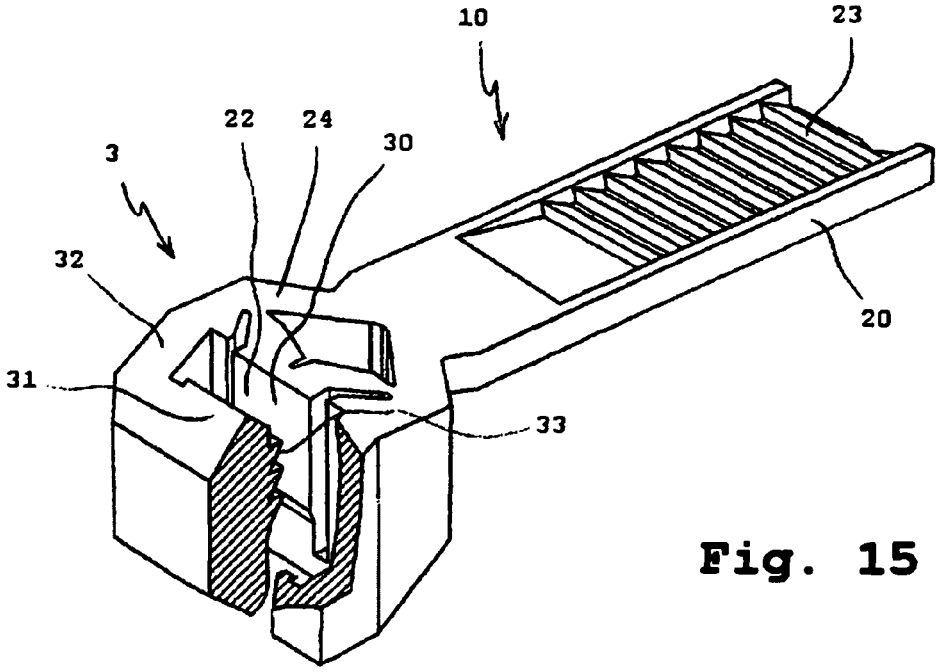
FIG. 15 shows a partially cut-away perspective view of a third embodiment of a clamping device according to the invention and a portion of a flexible strip connected thereto.

FIG. 15 shows a third embodiment of a clamping device 3 according to the invention and a portion of a flexible strip 20 which is connected to the clamping device 3. As is the case with the first embodiment of the clamping device 1 and the second embodiment of the clamping device 2 described in the foregoing, the assembly 10 of the third embodiment of the clamping device 3 and the strip 20 is destined to be applied as tie wrap 10. In general, the third embodiment of the clamping device 3 functions in the same way as the first embodiment of the clamping device 1 and the second embodiment of the clamping device 2, in the sense that it is capable of tightening itself around a strip portion 21 under the influence of a pulling force.

A notable difference between the third embodiment of the clamping device 3 with respect to the first embodiment of the clamping device 1 and the second embodiment of the clamping device 2 is that it has a closed shape, i.e. that it is not capable of allowing a sideward inserting of a strip portion 21. Instead, a user of the tie wrap 10 needs to put a free end of the strip 20 through an opening 22 in the clamping device 3, and subsequently pull the strip 20 over such a length that a desired size of a thus formed loop is obtained in the strip 20, as is the case with conventional tie wraps having a ring-shaped retaining element. By pivotably arranging components of the clamping device 3 with respect to each other, it is achieved that the clamping device 3 is capable of both tightening itself around a strip portion 21 and allowing a displacing of the strip 20 through the clamping device 3, depending on the way in which the strip 20 and/or the clamping device 3 are loaded. The clamping device 3 distinguishes itself by the possibility to remove the strip 20 again when a space around the strip portion 21 which is located in the clamping device 3 is increased by exerting force in certain directions, wherein the strip portion 21 is detached from one or more components of the clamping device 3 to which it was engaged in an earlier stage.

In the clamping device 3, the following components are distinguishable: a strip support element 30 which is located at the side of the fixed connection to the strip 20, two closure parts 32 pivotably connected to the strip support element 30, and a ratchet part 31 which is connected to both closure parts 32, and of which the toothing 33 is directed at the strip support element 30.

Figure 16:
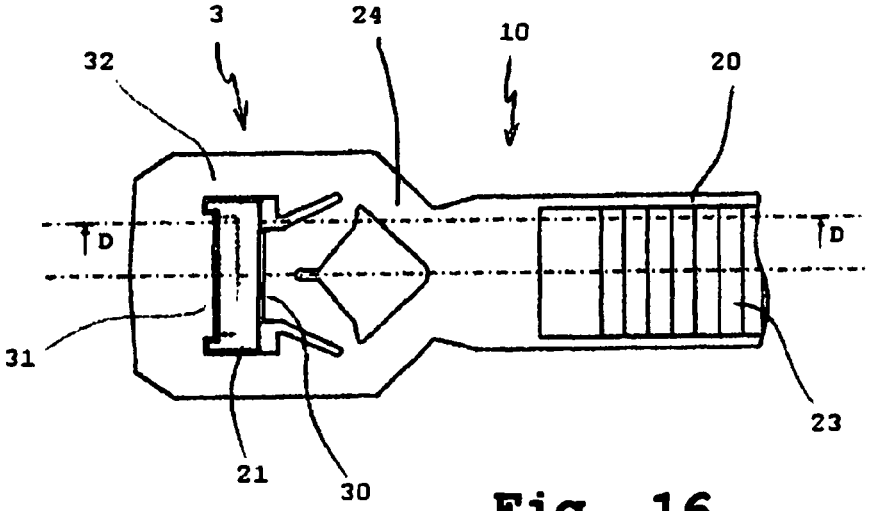
FIG. 16 shows a top view of the clamping device according to the third embodiment of the invention and a portion of the flexible strip, wherein the strip is extending through the clamping device, and the clamping device is in a closed condition.
Figure 17:
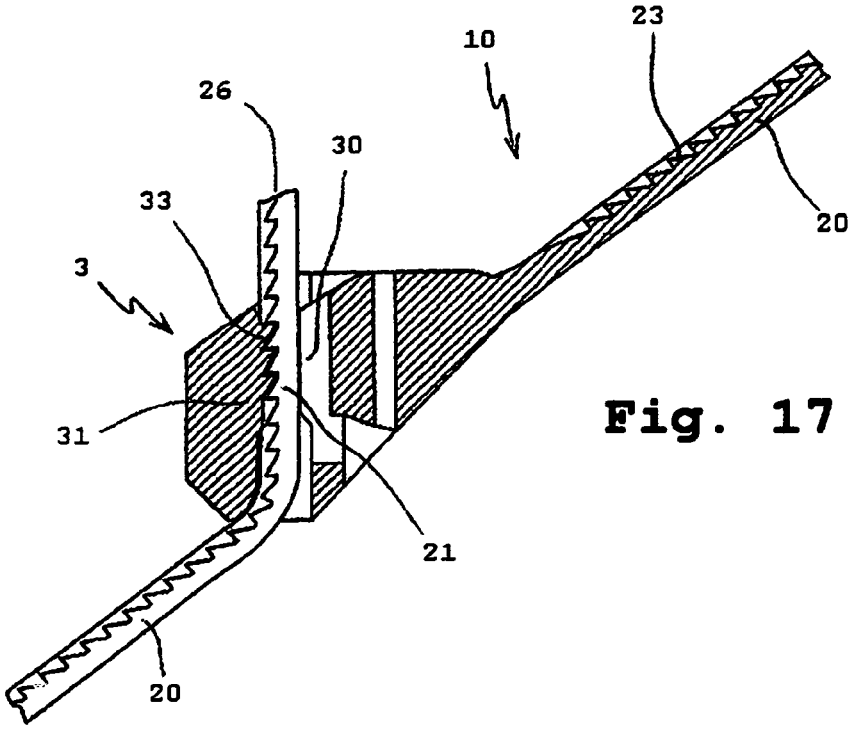
FIG. 17 shows a view of a longitudinal section along line D-D in FIG. 16.

FIG. 16 illustrates how the strip 20 is placed in the clamping device 3. When the strip 20 is pulled through the clamping device 3, the ratchet part 31 of the strip support element 30 is continually pushed away when the toothings 23, 33 of the strip 20 and the ratchet part 31 are moving over each other, each time until teeth of the toothings 23, 33 end up behind each other, and the toothings 23, 33 are exactly engaging, as illustrated in FIG. 17. A limited relative movement of the components of the clamping device 3 is possible on the basis of the pivotable connection between the closure parts 32 and the strip support element 30.

Figure 18:
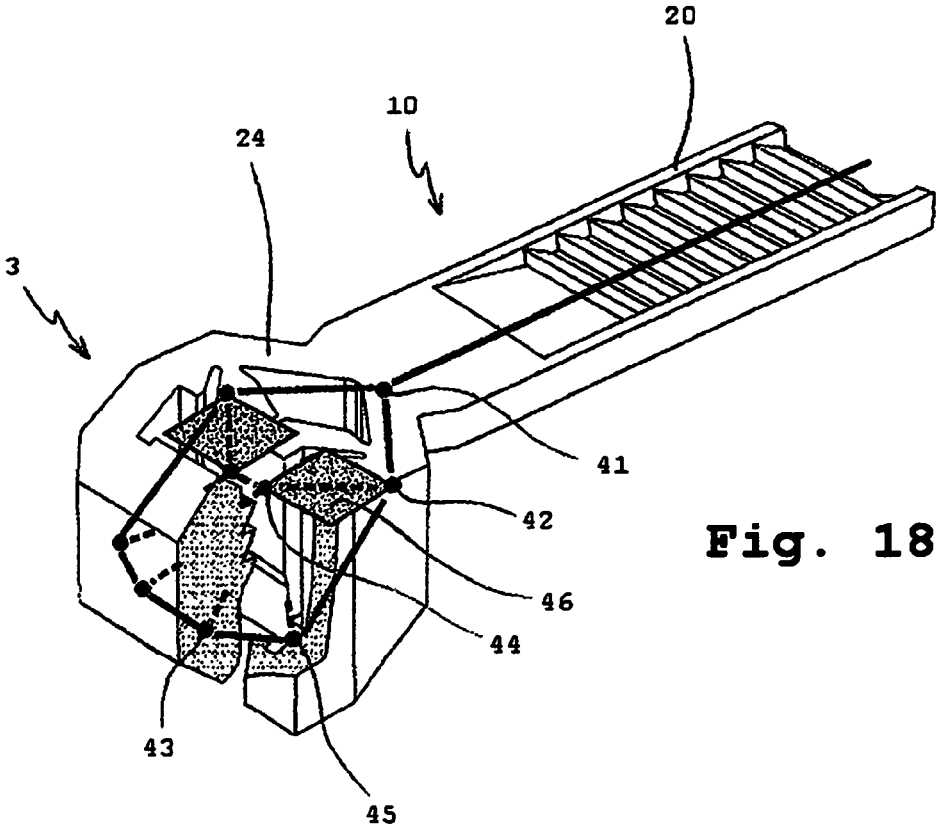
FIG. 18 diagrammatically shows a combination of forces which is obtained under the influence of a pulling force in the clamping device according to the third embodiment of the invention.
Figure 19:
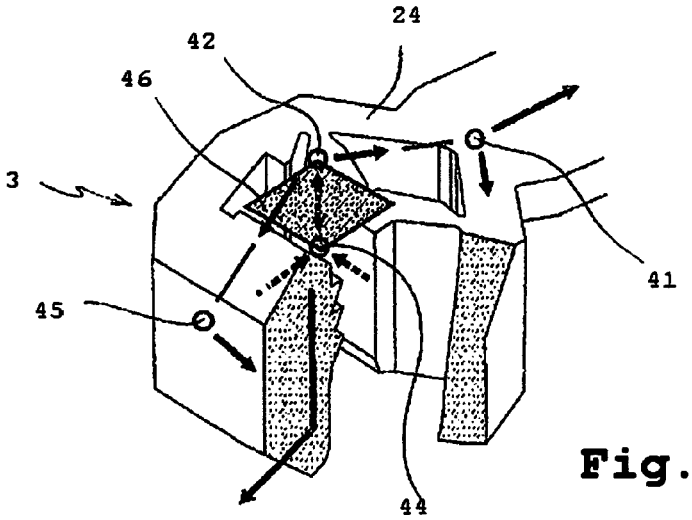
FIG. 19 diagrammatically shows a combination of forces which is obtained when the clamping device according to the third embodiment of the invention is pulled on the one hand, and the flexible strip is pulled in a position in which it is extending through the clamping device on the other hand.

FIG. 18 is comparable to FIGS. 8 and 13, and FIG. 19 is comparable to FIGS. 9 and 14. Therefore, both figures relate to a combination of forces as may occur in the clamping device 3. In these figures, it can be seen that when a pulling force is exerted on the clamping device 3, it acts at a single point 41 on the clamping device 3. A side of the clamping device at which this point 41 is located, will hereinafter be indicated as top side.

From the top side of the clamping device 3, the pulling force is transmitted more downward through a attachment point 42 of a closure part 32, and travels further to the ratchet part 31 through a point 45 at the position of a connection between the closure part 32 and the ratchet part 31. When a strip portion 21 is located in the clamping device 3, the clamping device 3 is tightened around the strip portion 21 under the influence of the pulling force, wherein the various components of the clamping device 3 are pushing against the strip portion 21. Particularly the closure parts 32 play an important role in this process. Apart from that, a plane 46 in which the pushing force exerted by the closure parts 32 is acting in this clamping device 3 is substantially parallel with respect to a direction in which the pulling force is acting from the attached strip 20 on the clamping device 3. FIG. 19 illustrates the fact that the combination of forces described in the foregoing is obtained when the strip is pulled against the ratchet part 31 in an upward direction, i.e. when a free portion 26 of the strip 20 is at an angle with respect to the portion 21 of the strip 20 which is located in the clamping device 3.

In the case of the shown third embodiment of the clamping device 3 it may be more bothersome to position the strip 20 in the proper manner therein than in the case of the first embodiment of the clamping device 1 and second embodiment of the clamping device 2 described in the foregoing. On the other hand, there is no need to apply means for the locking of a coupling between the clamping device 3 and a strip portion 21 in the third embodiment of the clamping device 3, because this clamping device 3 is not capable of assuming an opened condition.

Figure 20:
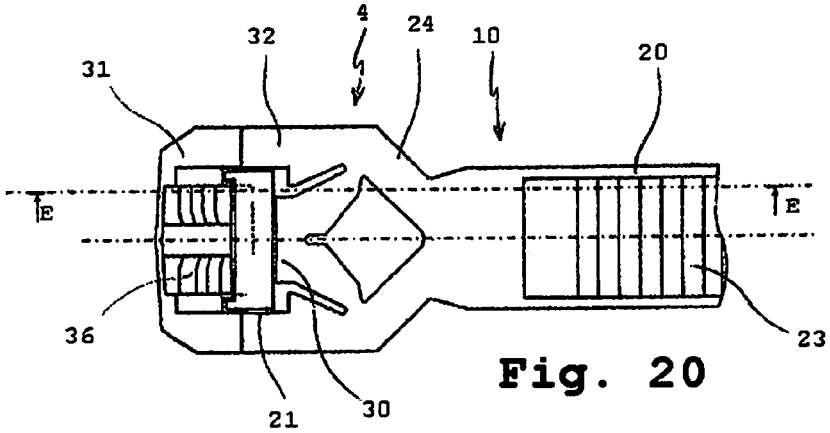
FIG. 20 shows a top view of a clamping device according to a fourth embodiment of the invention and a portion of the flexible strip, wherein the strip is extending through the clamping device, and the clamping device is in d closed condition.
Figure 21:
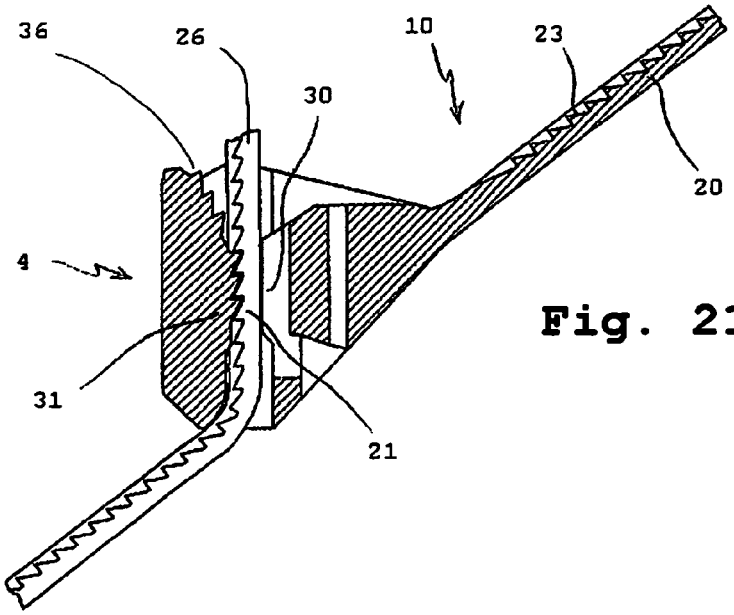
FIG. 21 shows a view of a longitudinal section along line E-E in FIG. 20.

FIGS. 20 and 21 show a fourth embodiment of a clamping device 4 according to the invention and a portion of a flexible strip 20 which is connected to the clamping device 4, in a condition in which a portion 21 of the strip 20 is extending through the clamping device 4.

The fourth embodiment of the clamping device 4 is almost equal to the third embodiment of the clamping device 3. A difference to the third embodiment of the clamping device 3 is that the toothing 33 of the ratchet part 31 of the fourth embodiment of the clamping device 4 comprises two strips 36 having teeth. Due to this, the possibility of alternately moving the teeth of the toothing 23 at the strip 20 along the teeth of these strips 36, which has been described earlier, is offered, as a result of which a force which is needed to pull the strip 20 through the clamping device 4, may be less high than when the toothing 33 of the ratchet part 31 would not be divided in two parts 36.

It will be clear to a person skilled in the art that the scope of the present invention is not limited to the examples discussed above, but that various amendments and modifications thereof are possible without deviating from the scope of the invention as defined in the appended claims.

In the shown examples, the strip 20 has a cross-section which is generally rectangular. That does not alter the fact that the cross-section of the strip 20 may have other shapes. It may, for example, also be circular, triangular or V-shaped. In general, it is true that a proper functioning of the clamping device 1, 2, 3, 4 is guaranteed when a shape of the space 22 in the clamping device 1, 2, 3, 4 for receiving a strip portion 21 is adapted to the shape of the cross-section of the strip 20.

The way in which in clamping devices 1, 2 which are capable of assuming an open position, a closure of the clamping devices 1, 2 is locked, can correspond to applying hook elements 34, as has been described in the foregoing. However, within the scope of the invention, various other possibilities are feasible. The same is true for the way in which the engagement of the at least one ratchet part 31 of the clamping device 1, 2, 3, 4 to a strip portion 21 is guaranteed. In connection with the shown examples, an application of engaging toothings 23, 33 has been described, but there are also other possibilities, for example an application of one or more pins which are fixedly connected to the ratchet part 31, and which are capable of pushing themselves in the strip 20. Even an embodiment in which the engagement only takes place on the basis of friction between surfaces of the clamping device 1, 2, 3, 4 and the strip portion 21, wherein no further auxiliary means are being applied, is one of the possibilities.

The clamping device 1, 2, 3, 4 can be provided with a handle for facilitating the handling of the clamping device 1, 2, 3, 4, wherein such a handle is preferably positioned at a side of the clamping device 1, 2, 3, 4 where the strip 20 enters the clamping device 1, 2, 3, 4.

Whenever a pivotable arrangement of a component of the clamping device 1, 2, 3, 4 is part of the shown examples, such an arrangement is realized on the basis of a recess of material at the position of an abutment of the respective component to another component. This way of realizing a pivoting action is very practical, which does not alter the fact that there are other possibilities within the scope of the present invention. When components of the clamping device 1, 2, 3, 4 are manufactured from a material such as nylon, and pivots are realized on the basis of recesses in the material, it is advantageous when a reinforcing technique such as cold-pressing is applied.

The clamping device 1, 2, 3, 4 according to the invention may be manufactured by means of injection molding. It is advantageous for clamping devices 1, 2 which may have an opened position when they are manufactured in said opened position.

The invention can be applied in a great variety of fields, including the field of tie wraps, tension belts, waistbelts and closing arrangements of bags.

In the foregoing, a tie wrap 10 has been described, which comprises a clamping device 1, 2, 3, 4 and a flexible strip 20 connected thereto, wherein the clamping device 1, 2, 3, 4 is adapted to receive a portion 21 of the strip 20 and retain the strip portion 21. Different from what is the case with known tie wraps, the clamping device 1, 2, 3, 4 is adapted to actively tighten itself around a strip portion 21 under the influence of a pulling force. Preferably, the clamping device 1, 2, 3, 4 is adapted to direct a pulling force around a strip portion 21 received in the clamping portion 1, 2, 3, 4, wherein, also under the influence of the pulling force, parts 31, 32 which are contacting the strip portion 21 are pushing off against the strip portion 21 and are exerting a pushing force thereon by doing so. The higher the pulling force, the more tightly the clamping device 1, 2, 3, 4 wraps itself around the strip portion 21. On the basis of this fact, a clamping action of the clamping device 1, 2, 3, 4 on the strip portion 21 is guaranteed in a large range of pulling forces, wherein high pulling forces can be accounted for.

In an embodiment, the clamping device 1, 2 comprises pivotably arranged parts 31, 32, and the clamping device is capable of assuming an opened condition and a closed condition, wherein, in the opened condition, the clamping device 1, 2 allows for free passage for a strip portion 21 to and from a space 22 in the clamping device 1, 2 for receiving and accommodating the strip portion 21, and wherein, in the closed condition, the clamping device 1, 2 retains the strip portion 21. In this embodiment, inserting a strip portion 21 in the clamping device 1, 2 is facilitated, and it can also be possible to use the tie wrap 10 several times, namely by putting the clamping device 1, 2 to the opened condition again after an application.

What is claimed is:

1. A clamping device for receiving and retaining a portion of a flexible body having an elongated shape, said clamping device comprising:

a space for receiving the portion of the body, a support element, supporting the body in a received position by exerting a pushing counterforce, two or more assemblies of force parts, comprising closure parts and attachment parts, said parts being pivotably connected to each other, said clamping device comprising at least one part of a surface that contacts a portion of the flexible body in received position and that is provided with means that enhance engagement of the surface to the portion of the body, said receiving space having a longitudinal direction extending with small deviation parallel with respect to a longitudinal direction of the said portion of the flexible body in received position, said assemblies of force parts being arranged in a way that exerting a pulling force on the clamping device causes a pulling force towards each other on the support element and the assemblies of force parts and an exertion by the support element and the assemblies of force parts of pushing force to the portion of the body in received position, said assemblies of force parts being flexibly connected to the support element, being biased to an initial closed position in which being wrapped tightly around the portion of the body, movable therefrom to an open position and movable therefrom again to the said closed position, said assemblies of force parts being positioned with small deviation in a mirror-symmetrical manner and each connected to the support element rotatably along an axis which is extending with small deviation parallel with respect to the said longitudinal direction of the receiving space, said assemblies of force parts being oriented in a way that in the said open position a passageway is provided that is open along the full length of the receiving space and runs in a direction transverse to the said longitudinal direction of the receiving space between the receiving space and one exterior side of the clamping device, referred to as the open side of the clamping device, giving passage to the said portion of the body in said transverse direction to and from the receiving space, two or more said attachment parts realizing the attachment of the clamping device and the exertion of the said pulling force on the clamping device, said attachment parts being attached to the clamping device at different attachment locations each comprising a pulling force acting point where the exertion of the pulling force mainly takes place, said pulling force acting points being located on the said closure parts of the assemblies of force parts, being movable together with the closure parts relative to each other and being located at a level which is perpendicular to the said direction of passage and is situated at a distance from the portion of the body towards the said open side of the clamping device.

2. Clamping device according to claim 1 wherein two or more said assemblies of force parts are comprising ratchet parts wherein a part of the surface of the ratchet parts is provided with means that enhance engagement to the portion of the body.

3. Clamping device according to claim 2 , wherein it is true for each of at least two said assemblies of force parts in the clamping device that it contains four points, each of said points forming at least one pair with another of these four points by being attached to it by a part of the assembly of force parts, said pairs to some extend being pivotable around the said points, said points consisting of the said pulling force acting point, a connecting point of the assembly of force parts, a first contact point at a force part of the assembly of force parts making contact to a portion of the body, and a second contact point making contact to the said support element of the clamping device.

4. Clamping device according to claim 3 wherein each of the said pulling force acting points is located in a closing direction of the clamping device with respect to an imaginary plane in which the other three points of the said four pivot points of the respective assembly of force parts are located.

5. Clamping device according to claim 4 wherein each of the said first contact points is located at a part of the surface of the respective assembly of force parts that is provided with means that enhance engagement to the portion of the body.

6. Assembly of a flexible body having an elongated shape and a clamping device according to claims 1, 3, 4 or 5, wherein the body and the clamping device are attached to each other.

7. Clamping device according to claims 1, 3, 4 or 5 comprising locking elements which are located on the assemblies of force parts, and which engage each other when the assemblies of force parts are put to the said closed position, locking the force parts in that position.

8. Assembly of a flexible body having an elongated shape and a clamping device according to claim 7, wherein the body and the clamping device are attached to each other.

9. Clamping device for receiving and retaining a portion of a flexible body having an elongated shape, said clamping device comprising:

a space for receiving a portion of the body, a support element, supporting the body in a received position by exerting a pushing counterforce, two or more assemblies of force parts, comprising closure parts, attachment parts and ratchet parts, said parts being pivotably connected to each other, said clamping device comprising at least one part of a surface that contacts a portion of the flexible body in received position that is provided with means that enhance engagement of the surface to the portion of the body, said assemblies of force parts being flexibly connected to the support element, being biased to an initial closed position in which being wrapped tightly around the portion of the body and movable therefrom to an open position providing an increase of space between the support element and the ratchet parts, said assemblies of force parts being arranged in a way that exerting a pulling force on the clamping device causes a pulling towards each other of the support element and the assemblies of force parts and an exertion by the support element and the assemblies of force parts of a pushing force to the portion of the body in received position, said ratchet parts being connected to each other and to the closure parts, wherein a toothing of the ratchet parts is directed at the support element, said two or more attachment parts realizing the attachment of the clamping device and a transmission of the said pulling force to the clamping device, said attachment parts with one end being attached to the clamping device at different attachment locations each comprising a first pulling force acting point where the exertion of the pulling force mainly takes place and with the other end being together connected to an element at a location with a single second acting point where the pulling force on the clamping device is exerted, said first pulling force acting points being located on the said closure parts of the said assemblies of force parts, being movable relative to each other, together with the said closure parts and exerting a pushing force on the said closure parts from two directions when a pulling force is exerted on the said location comprising the said second acting point.

10. Clamping device according to claim 9 , wherein it is true for each of at least two said assemblies of force parts in the clamping device that it contains four points, each of said points forming at least one pair with another of these four points by being attached to it by a part of the assembly of force parts, said pairs to some extend being pivotable around the said points, said points consisting of the said pulling force acting point, a connecting point of the assembly of force parts, a first contact point at a force part of the assembly of force parts, making contact to a portion of the body, and a second contact point making contact to the said support element of the clamping device.

11. Clamping device according to claim 10, wherein the said means that enhance engagement of the surface to the portion of the body comprise at least two separate, parallel rows of teeth at a location where the said receiving space a portion of the body exits the clamping device, wherein these teeth are positioned with an engaging direction that causes exertion of a pulling force on the portion of the body in a longitudinal direction when the teeth engage teeth on the portion of the body.

12. Clamping device according to claim 9, wherein the said means that enhance engagement of the surface to the portion of the body comprise at least two separate, parallel rows of teeth at a location where the said receiving space a portion of the body exits the clamping device, wherein these teeth are positioned with an engaging direction that causes exertion of a pulling force on the portion of the body in a longitudinal direction when the teeth engage teeth on the portion of the body.

13. Assembly of a flexible body having an elongated shape and a clamping device according to claims 9, 10, 11 or 12, wherein the body and the clamping device are attached to each other.

14. Clamping device according to claim 1 comprising locking elements which are located on the assemblies of force parts, and which engage each other when the assemblies of force parts are put to the said closed position, locking the force parts in that position.

15. Assembly of a flexible body having an elongated shape and a clamping device according to claim 1 or 14, wherein the body and the clamping device are attached to each other.

* * * * *